US007856776B2

(12) United States Patent
Van Der Lee

(10) Patent No.: US 7,856,776 B2
(45) Date of Patent: Dec. 28, 2010

(54) CONSTRUCTION SYSTEM FOR CONSTRUCTING PLANE STRUCTURES

(75) Inventor: Leonardus Johannes Maria Van Der Lee, Drunen (NL)

(73) Assignee: Press Brick System B.V., Drunen (NL)

( * ) Notice: Subject to any disclaimer, the term of this patent is extended or adjusted under 35 U.S.C. 154(b) by 79 days.

(21) Appl. No.: 11/570,397

(22) PCT Filed: Jun. 10, 2005

(86) PCT No.: PCT/NL2005/000429

§ 371 (c)(1),
(2), (4) Date: Aug. 1, 2007

(87) PCT Pub. No.: WO2005/121475

PCT Pub. Date: Dec. 22, 2005

(65) Prior Publication Data

US 2008/0196339 A1 Aug. 21, 2008

(30) Foreign Application Priority Data

| | | |
|---|---|---|
| Jun. 11, 2004 | (NL) | 1026397 |
| Jul. 14, 2004 | (NL) | 1026651 |
| Sep. 17, 2004 | (NL) | 1027062 |

(51) Int. Cl.
*E04H 1/00* (2006.01)

(52) U.S. Cl. ..... 52/235; 52/506.03; 52/506.02; 52/506.06; 52/506.08; 52/385; 52/386; 52/387

(58) Field of Classification Search ..... 52/235, 52/506.03, 506.02, 506.06, 506.08, 385, 52/386, 387
See application file for complete search history.

(56) References Cited

U.S. PATENT DOCUMENTS 1,723,500 A * 8/1929 Campbell ..... 52/715

(Continued)

FOREIGN PATENT DOCUMENTS

CA 2218783 4/1999

(Continued)

*Primary Examiner*—Richard E Chilcot, Jr.
*Assistant Examiner*—Mark R Wendell
(74) *Attorney, Agent, or Firm*—The Webb Law Firm

(57) ABSTRACT

The invention relates to a plane structure, such as a wall, floor, ceiling or roof, comprising profiles (3A) extending mutually parallel in a first direction, elements (1) which can be coupled releasably to the profiles, wherein a profile extends on both sides of an element and wherein the elements are coupled to both adjacent profiles. The invention also relate to the elements and profiles for use in this structure, as well as to the method for building such a structure. An automatic positioning of the elements is created as a result of these measures; this then no longer depends on the skill of the builder. Owing to the releasability of the coupling the elements can simply be stacked on the profiles.

8 Claims, 8 Drawing Sheets

U.S. PATENT DOCUMENTS

| | | | | | |
|---|---|---|---|---|---|
| 1,861,359 | A | | 5/1932 | Pyron | |
| 1,968,728 | A | * | 7/1934 | Wheeler | 52/125.3 |
| 2,005,427 | A | | 6/1935 | Lenke | 72/19 |
| 2,245,785 | A | | 6/1941 | Jentzer, Jr. | 189/88 |
| 2,324,643 | A | * | 7/1943 | Phillips | 52/300 |
| 4,170,859 | A | * | 10/1979 | Counihan | 52/779 |
| 4,765,111 | A | | 8/1988 | Osawa | 52/509 |
| 5,363,620 | A | * | 11/1994 | Liu | 52/482 |
| 5,373,676 | A | * | 12/1994 | Francis et al. | 52/387 |
| 6,234,790 | B1 | * | 5/2001 | Van Laar et al. | 432/247 |
| 6,374,563 | B1 | | 4/2002 | Erskine et al. | 52/506.03 |
| 7,207,147 | B2 | * | 4/2007 | Price et al. | 52/586.1 |

FOREIGN PATENT DOCUMENTS

| | | |
|---|---|---|
| DE | 2013857 | 10/1971 |
| DE | 8914892 | 4/1990 |
| EP | 1101881 | 5/2001 |
| GB | 563445 | 8/1944 |

* cited by examiner

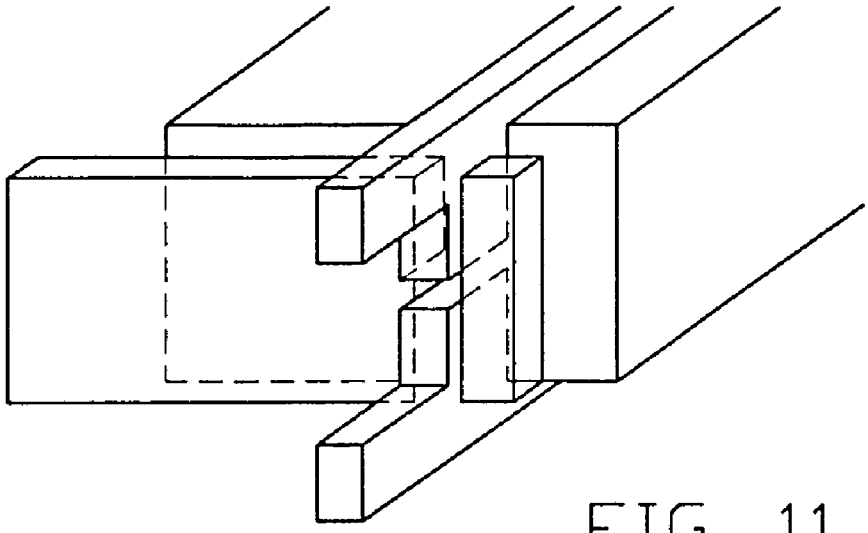
FIG. 11
FIG. 11A
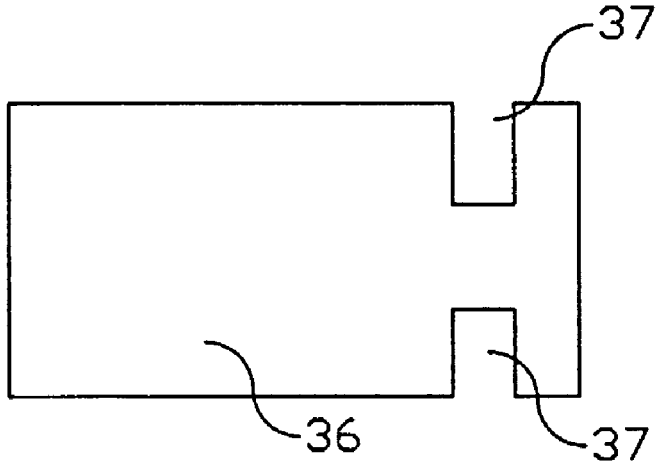
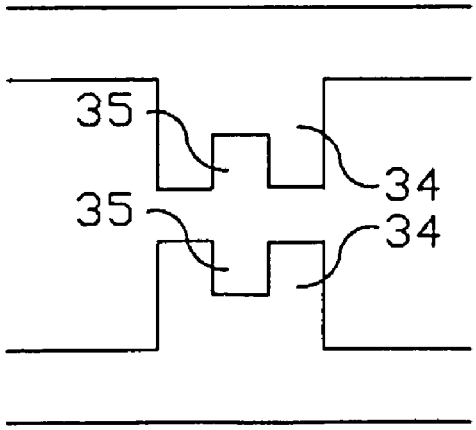
FIG. 11B

CONSTRUCTION SYSTEM FOR CONSTRUCTING PLANE STRUCTURES

The invention relates to a construction system for constructing plane structures such as walls, floors or ceilings. The invention relates more particularly to a plane structure, such as a wall, floor, ceiling or roof constructed with such a construction system.

In traditional building use is made of brickwork for the purpose of constructing flat vertical structures such as walls. Conventional brickwork is becoming increasingly more expensive due to rising wage costs.

An object of the present invention is to provide such a structure, wherein hardly any professional skill is required for the assembly thereof, and wherein construction speed is greater.

Horizontal bearing structures are usually made from concrete constructions, i.e. a monolith is formed on-site. Such a monolith has the drawback that it can only be removed by being destroyed. Reuse of the components which become available is only possible to a small extent, and then for other purposes with less added value.

Another objective of the present invention is to provide such a structure which can be constructed easily and quickly, but which can also be quickly dismantled again, and wherein the components which become available upon disassembly are suitable for reuse.

For pitched roofs use is generally of roof tiles. In order to support these roof tiles use is made of roof boarding which is placed on roof rafters and on which tile battens are arranged.

An object of the present invention is to provide a structure which is suitable for application as a pitched roof, wherein fewer support measures are necessary.

These objectives are achieved by such a structure which comprises profiles extending mutually parallel in a first direction and elements which can be coupled releasably to the profiles, wherein a profile extends on both sides of an element and wherein the elements are coupled to both adjacent profiles.

An automatic positioning of the elements occurs as a result of these measures; this then no longer depends on the skill of the builder. Owing to the releasable nature of the coupling, the elements can simply be stacked on the profiles. After a row of elements has been completed, the following profile is placed. The use of adhesive or mortar is unnecessary here.

Particularly when the structure according to the invention is used in horizontal structures such as floors and ceilings, there results the possibility of reusing the elements. These can after all easily be removed again. It is possible in principle to apply a concrete top layer to the structure according to the present invention, although the option of reusing the elements is hereby lost.

In the application as a sloping structure in a roof, use can also be made of horizontally extending profiles to support the elements. With a suitable dimensioning these can be chosen such that the number of rafters can be reduced. The roof boarding and the tile battens can in any case be dispensed with.

In order to obtain the greatest possible strength, the elements are adapted to form a coupling between the elements and the profiles at the position of the end walls of the elements extending transversely of the longitudinal direction of the profiles.

An anchoring between profile and element is hereby obtained on both end surfaces of the element. The resistance to lateral forces is hereby increased greatly compared to a situation where the elements are connected to the profile at only a single location or even two locations close to each other.

In the first instance the structure according to the invention is suitable for building a structure with the appearance of brickwork. It is however also possible with the system according to the invention to manufacture a structure with a different appearance, depending on materials, forms and dimensions.

The use of a form-locking coupling makes stacking, i.e. mutual positioning, of the elements and profiles possible. Furthermore, the use of additional fixing means, such as glue or mastic, hereby becomes unnecessary.

According to another preferred embodiment, the coupling is adapted to lock the elements and the profiles in the longitudinal direction of the profiles and in the direction perpendicularly of the plane of the plane structure. An effective fixation of the elements and the profiles is obtained due to this measure, wherein the ability to stack and remove are ensured.

According to a more specific embodiment, the elements are provided with recesses which are arranged in their end walls and which are adapted for engagement by tongues arranged on the profiles. The recesses in the end walls of the elements can generally be arranged in simple manner. In the case of rigid elements use can be made of a machining process such as sawing or milling. This is likewise possible in the case of ceramic elements, although it is more attractive to provide the elements in the unfired form with such recesses, for instance with extrusion or by appropriate changing of the form.

The arrangement of bent tongues is also simple; in folded material such as galvanized steel, the tongues can be punched out and then folded. In the case of extruded material such as aluminium, the tongues can be formed during the extrusion as a folded part. The remaining parts can then be discharged.

Use is made of the profiles between the elements during forming of a structure according to the invention. Elements adjacent to each other transversely of the profile direction are therefore separated by a joint which has the thickness of the profile. It is however possible to increase the thickness of the joint through the use of auxiliary profiles or by providing the profile with thickened or protruding portions such that a space is created between the profile and the elements. The actual joint width is then the same as the thickness of the profile, with the addition of once or twice the effective height of the thickened or protruding portion.

The above discussed measures relate to the horizontal joints in the normal situation of a vertical structure, wherein the elements extend horizontally. It is of course possible in a vertical structure to place the elements vertically in their length direction; the profiles must then also be placed vertically. The profiles can also be placed both vertically and horizontally in sloping structures such as roofs.

Vertical joints of a certain width can also be formed by opting for tongues with a width equal to twice the depth of a groove plus the desired joint width.

Conversely, it is also possible to have the elements connect to each other in the longitudinal direction of the profiles by an appropriate choice of the width of the tongue.

The thus resulting joints can be filled with mastic, with joint mortar or with profiles, depending on the desired appearance.

It is attractive to make use of solid elements. This is particularly the case when use is made of ceramic elements, such as bricks, or of elements formed from wood, wood-like material such as pressed wood fibre, plastic or from other pressed natural fibre materials.

It is also possible however to make use of hollow elements, such as elements of plastic obtained by rotation moulding, injection moulding or extrusion. The end surfaces will be open in the case of extrusion. This will not however represent a problem in most applications. It is however also possible to manufacture such a hollow structural element from folded material, such as steel plate which is galvanized or made durable in other manner. In this latter case the inner wall of the structural element will not be required either.

An attractive preferred embodiment provides the measure that the element is provided on both end walls with a groove extending in the direction of the structure. The groove is easy to arrange and, because it is accessible from both long sides of the element, the groove can be used from both sides.

Yet another preferred embodiment provides the measure that the groove is placed adjacently of the centre of the end surface. This measure provides the option of placing the element in two different ways in the structure, viz. with the great distance between the groove and the outer side or with the small distance between the groove and the outer side. In both cases the protrusion of the element from the groove, the position of which is after all defined by the tongues of the profile, will be different. This effect can be used to make relief within the structure.

It is pointed out here that it is of course possible to arrange more than one groove in the end wall of the element; this provides even more possibilities for forming a relief.

The element does not however necessarily have to be simply a structural element; it can likewise be formed by an element fulfilling a second function in a building, such as a letterbox, a lighted nameplate, a lighted house number, a lighted street sign, or a bell push.

The possibility also exists of incorporating more structural functions in an element according to the invention. The element can thus be embodied as a lintel which is used to span frames. For this purpose the element is given a long form such that it spans the frame in question but moreover fits into the grid of the profiles and other elements. In order to achieve the required strength, it may be necessary to make the lintel higher than the normal element height. It is attractive however when the height also fits into the grid of the other profiles and elements, so that the height preferably equals a multiple of the nominal height of the normal elements.

The same consideration applies for sills which can be embodied in the same manner as lintels. Frames can also be incorporated in the structure.

The profiles comprise at least a part which extends in its longitudinal direction between the elements and which is provided with protrusions which are adapted to form a form-locking coupling together with recesses arranged in the elements.

These protrusions are preferably formed by folded tongues. This is a simple and inexpensive embodiment which is particularly applicable when the profile is manufactured from folded plate steel. As in the previous embodiment, the profiles can be manufactured from metal, such as plate steel. Use can be made for this purpose of galvanized plate steel, but for instance also of stainless steel. Nor are other metals such as aluminium precluded. Aluminium has the advantage that it can be formed by means of extrusion, whereby a great freedom of forms can be obtained. When a steel profile is applied, the form will have to be obtained by folding. It is however also possible to apply other materials, such as plastics, for instance fibre-reinforced plastics.

Another preferred embodiment provides the measure that the protrusions are folded alternately to either side and that the pitch of the tongues folded to one side is the same as the pitch of the elements in the built structure. The profile hereby obtains a good coupling in the form of a locking with elements located on both sides of the profile. For optimal locking the elements are herein engaged on both end surfaces by a protrusion.

In its simplest form the profile is formed by a strip of material. Such a strip has a bending stiffness only in the plane transversely of the plane of the strip and transversely of the plane of the structure. In order to also provide a certain rigidity in the plane of the structure the profile is provided with a part extending parallel to the plane of the built structure. An L-shaped cross-section is hereby obtained which has the necessary rigidity in both planes.

The above stated effects are improved when the profile is substantially T-shaped in cross-section. Such a T-shape is easy to produce by means of an extrusion process, although when the profile is made from folded plate steel it is not possible to prevent one of the legs of the T having a double material thickness.

The invention relates not only to the structure according to the invention and the separate components used in the building of a structure according to the invention, but also to the kit of different parts. A great number of advantages of the invention are after all only obtained when the elements are combined with the profiles. When special elements are applied in a structure, these will of course then also fall within the scope of the invention.

The invention also relates to a method for constructing a substantially plane structure, comprising the steps of placing a first profile which is provided with protrusions on at least one of its longitudinal sides, placing an array of elements adjacently of the first profile, wherein the elements are locked by means of form-locking with the profiles, placing at least one profile adjacently of the elements, wherein the profile is locked by means of form-locking with the profiles, and repeating these latter two steps until the structure is completed.

The present invention will be elucidated hereinbelow with reference to the accompanying drawings, in which:

FIG. 11 is a schematic perspective detail view of the fourth embodiment with an added anchor;

FIG. 11A shows a view of an anchor used in the fourth embodiment;

FIG. 11B shows a view of two profiles used in the fourth embodiment; and

Figure 1:
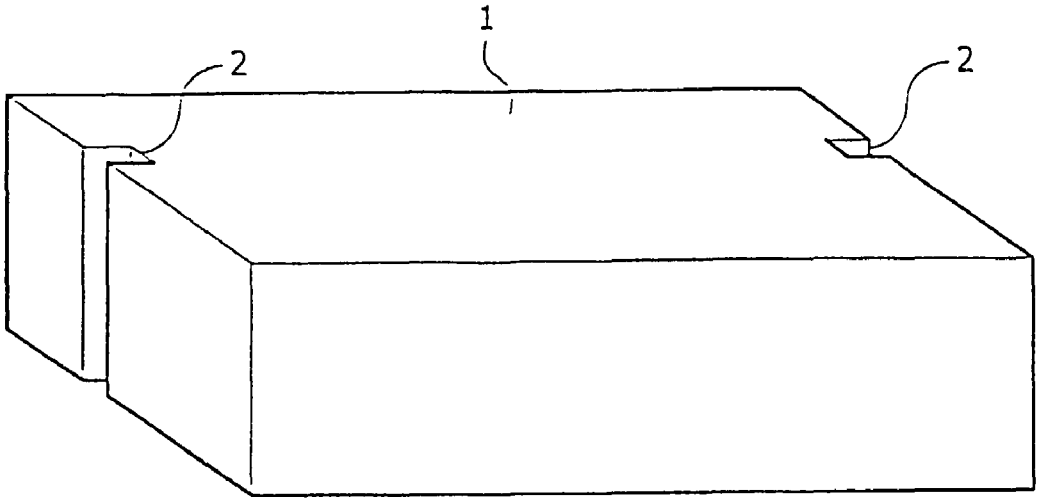
FIG. 1 shows a schematic perspective view of an element according to a first embodiment of the invention.

The block-like element 1 shown in FIG. 1 is formed by for instance ceramic material such as fired clay. It is however possible to make use of other materials, such as wood or products made up of wood fibres, such as MDF. It is also possible to make use of materials on a basis of paper, natural fibres, plastic or metal. Block-like element 1 is provided on each of its end walls 3 with a groove 2. This groove is for instance arranged by a machining process such as milling, but it is also possible to already recess the grooves during forming of the element. An example hereof is the forming of extruded bricks wherein the grooves are recessed during the extrusion process. The grooves are then fixed automatically when the bricks are fired.

Groove 2 is preferably placed slightly out of centre in the end surface 3. This provides the option of coupling the elements in two different ways to the profiles to be discussed below. The mutual position of the profiles and elements can hereby be varied, whereby a relief can be obtained in the formed structure.

Figure 2:
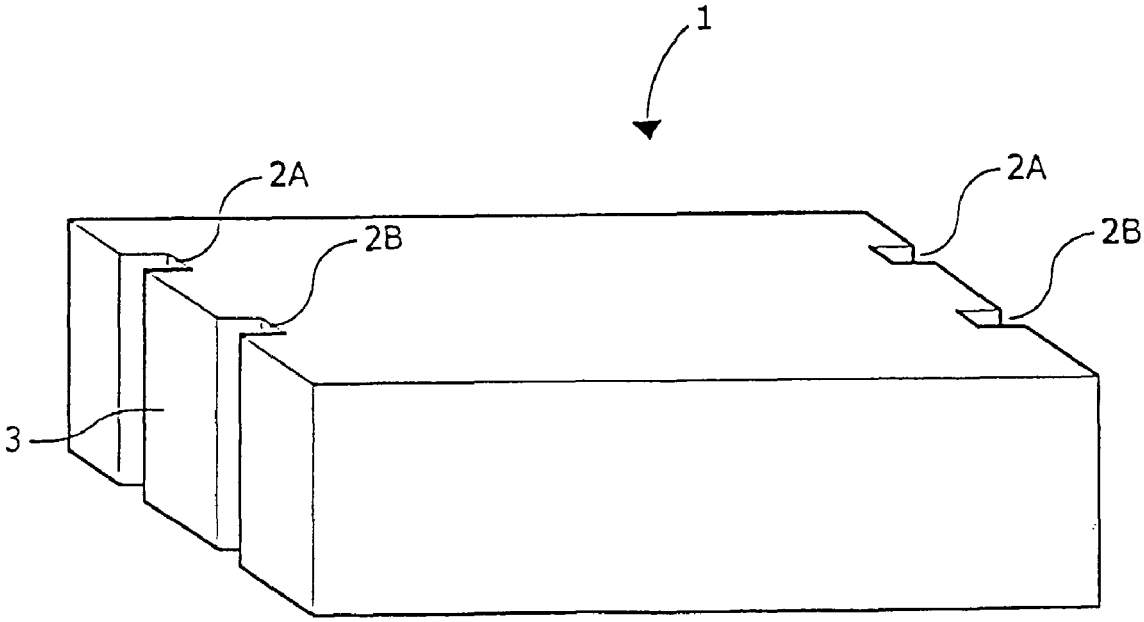
FIG. 2 shows a schematic perspective view of an element according to a second embodiment of the invention.

FIG. 2 shows a second embodiment of element 1, which is provided in each of its end walls 3 with two grooves 2*a*, 2*b* respectively. This provides the option, with a correct dimensioning, of coupling the elements in four different ways to the profiles to be discussed below.

It is however also possible to manufacture a hollow element. For this purpose the element can be assembled from two parts, or the element can be formed by an extruded element. The end surfaces of the extruded element can be closed with covers, depending on the application. It is however also possible to make use of elements of folded plate material, such as folded steel.

Figure 3:
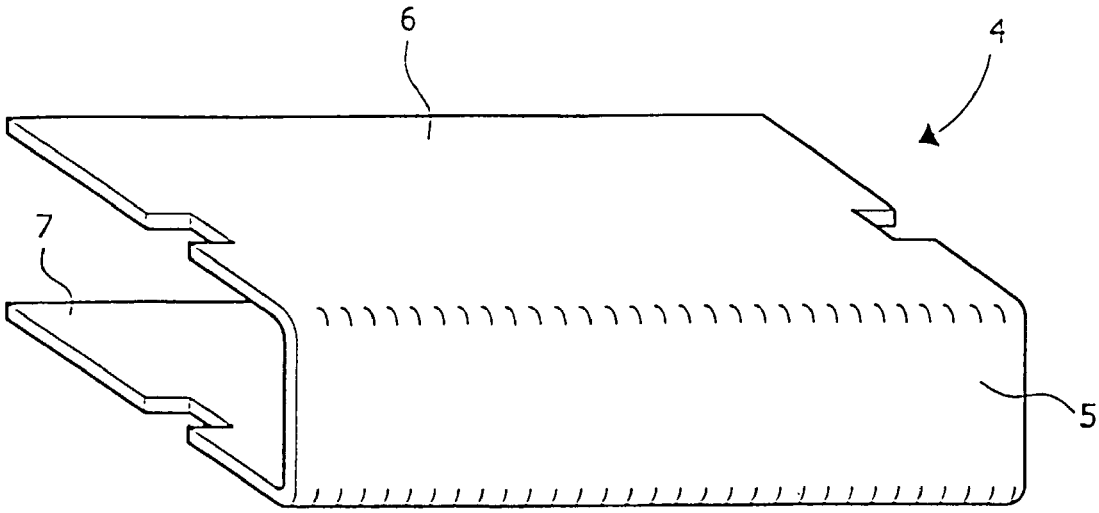
FIG. 3 shows a schematic perspective view of an element according to a third embodiment of the invention.

Such an element 4 is shown in FIG. 3. Formed from the plate material is a front surface 5 which is placed on the visual side of the structure. The plate from which the element is manufactured also comprises an upper wall 6 and a lower wall 7. Arranged in upper wall 6 and lower wall 7 is a recess 8 which, just as the groove 2 in the foregoing embodiments, serves to make a fixing connection to the profiles. The element further comprises end walls 9 which extend only as far as recesses 8. Incorporated in the element here are only those walls which have a structural, protective or decorative function.

Figure 4:
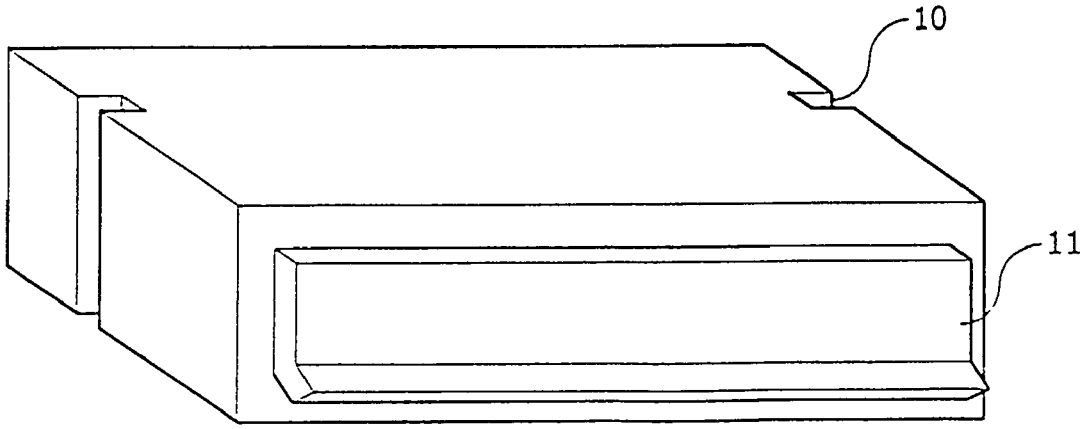
FIG. 4 is a schematic perspective view of a special element according to the invention.

In the manufacture of a construction from structures according to the invention it is attractive for other functions to be also incorporated in the elements. FIG. 4 thus shows a special element 10 which is provided with a letterbox with a flap 11.

Figure 5:
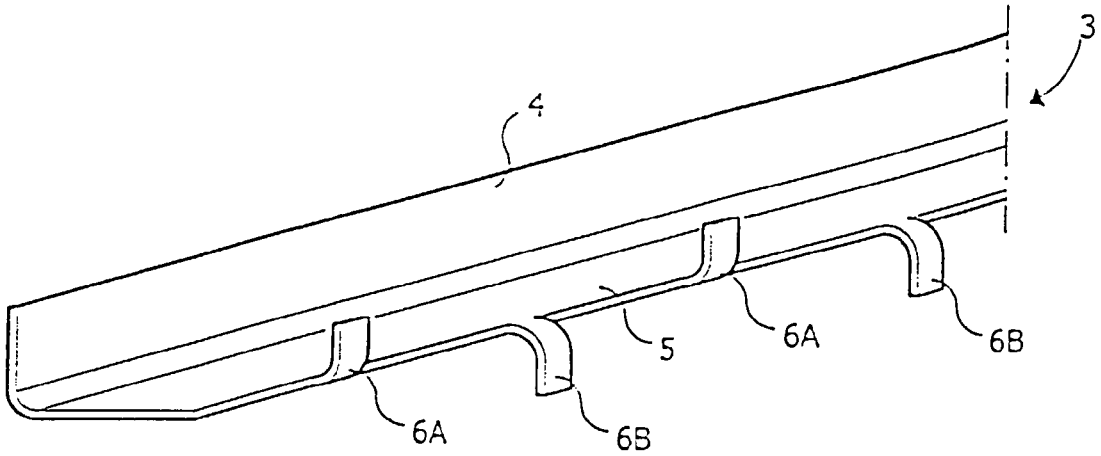
FIG. 5 is a schematic perspective view of a first embodiment of a profile according to the invention.

FIG. 5 shows a profile 13 which forms part of the construction system according to the invention. Profile 13 is preferably manufactured from aluminium, although other materials, such as other metals or plastics, can likewise be used.

The profile is substantially L-shaped with two legs 14, 15. Tongues 16 are arranged on the free edge of leg 15. These tongues 16 are folded alternately upward 16A and downward 16B. The distance between tongues 16 is important for the construction system. In the exemplary embodiment shown in FIG. 5 the distance between two upward bent tongues 16A is equal to the length of element 1. The distance between the downward bent tongues 16B is also equal to the length of element 1. In the present embodiment the tongues 16B are also placed in the middle between two tongues 16A. The appearance of a half-brick bond is then created during the construction of a structure according to the invention.

In the shown exemplary embodiment the leg 14 of profile 13 is folded upward; it is of course possible to fold the leg downward or place the profile the other way round.

Figure 6:
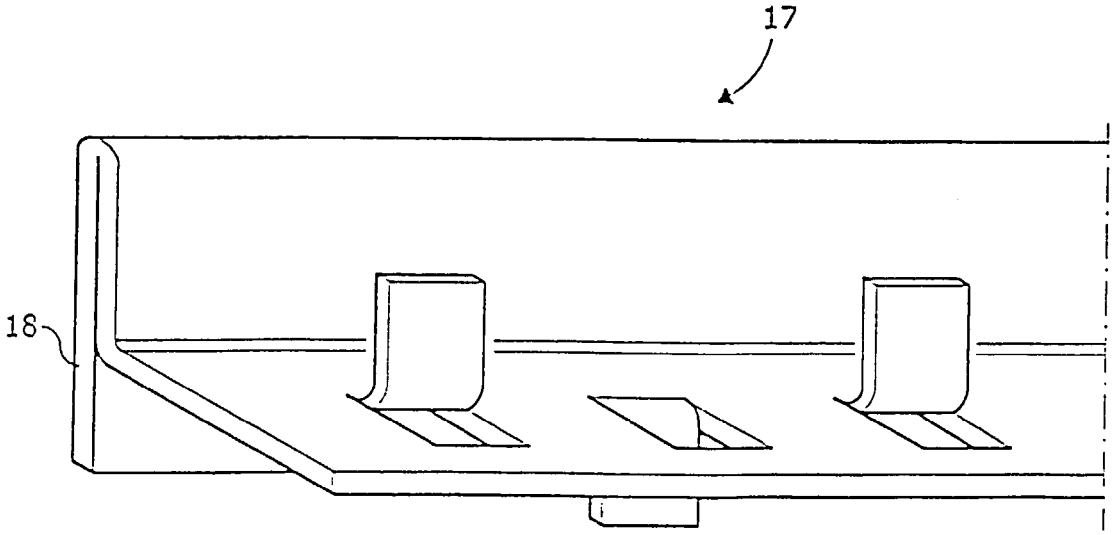
FIG. 6 is a schematic perspective view of a second embodiment of a profile according to the invention.

In FIG. 6 a profile 17 is placed which is distinguished from the profile shown in FIG. 5 by the double leg 18. A much greater rigidity is obtained due to this double leg 18, this being important in determined applications. Another difference from the profile shown in FIG. 5 is the fact that the leg 15 is wider; it extends beyond the tongues 16. This serves of course to increase the rigidity of the profile, but also provides a better support to the elements 1 connected to the profile.

Figure 7:
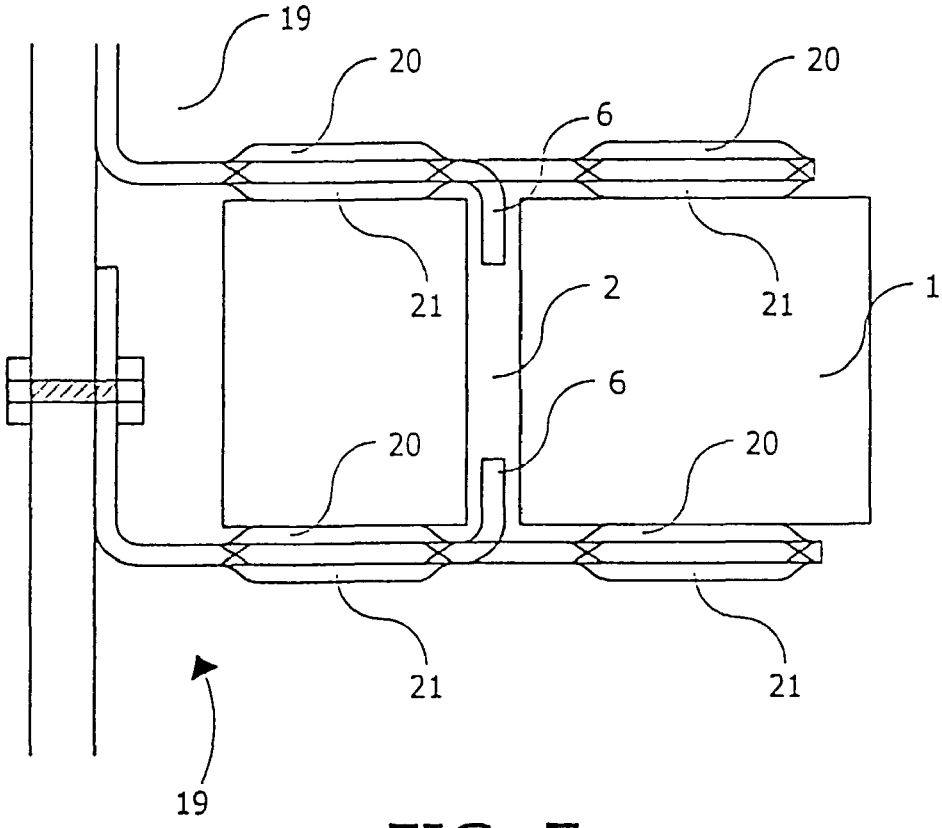
FIG. 7 is a cross-sectional view of a combination of two profiles according to a third embodiment, and an element placed between the profiles.

It is possible in principle to have elements 1 connect to each other when the profiles, which mutually separate the elements 1, are inserted into the elements. It is also possible however to enlarge the joint normally already present between the elements. Use can be made for this purpose of profiles 19 as shown in FIG. 7. Profiles 19 are provided for this purpose with protruding portions 20, which in FIG. 7 extend upward, and protruding portions 21 which extend downward. In the present exemplary embodiment the protruding portions 20 and 21 are arranged in rows extending in lengthwise direction of the profile.

Figure 8:
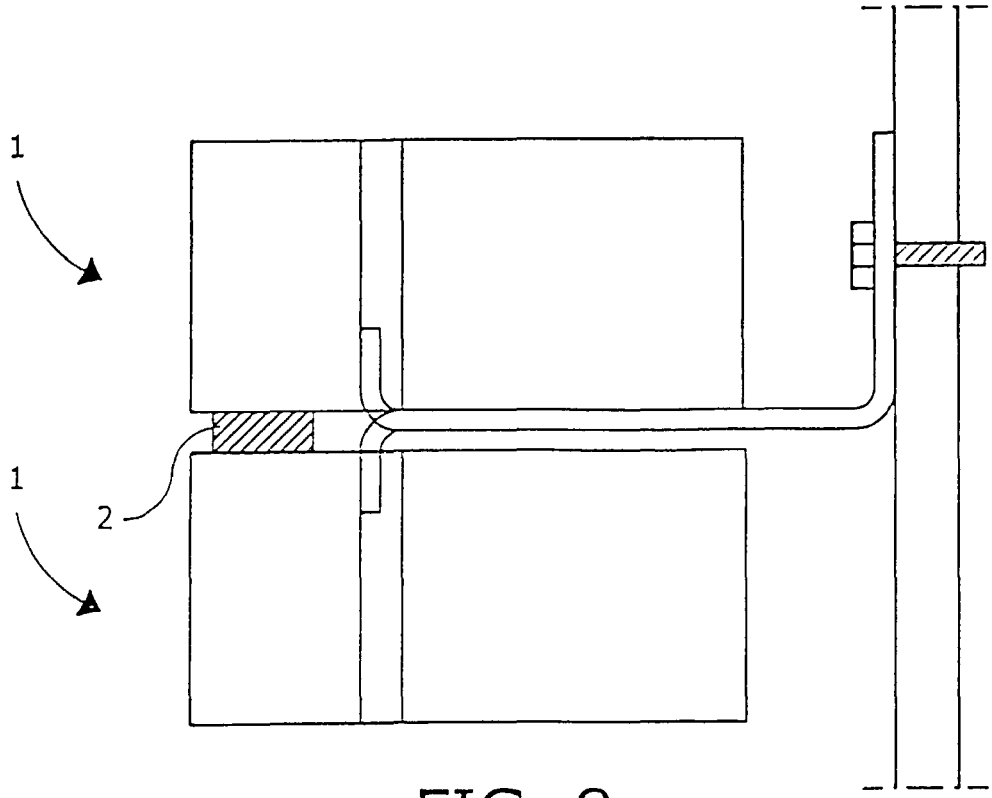
FIG. 8 shows a view corresponding with FIG. 7 of a variant.

Instead, or in combination therewith, it is also possible to make use of auxiliary profiles to provide a predetermined mutual distance between the elements, or between the elements and profiles 19. Such a situation is shown in FIG. 8. Profiles 22 manufactured for instance from plastic serve here to maintain the distance between elements 1. They moreover form a joint to the eye.

As stated above, use is preferably made of folded profiles.

Figure 9:
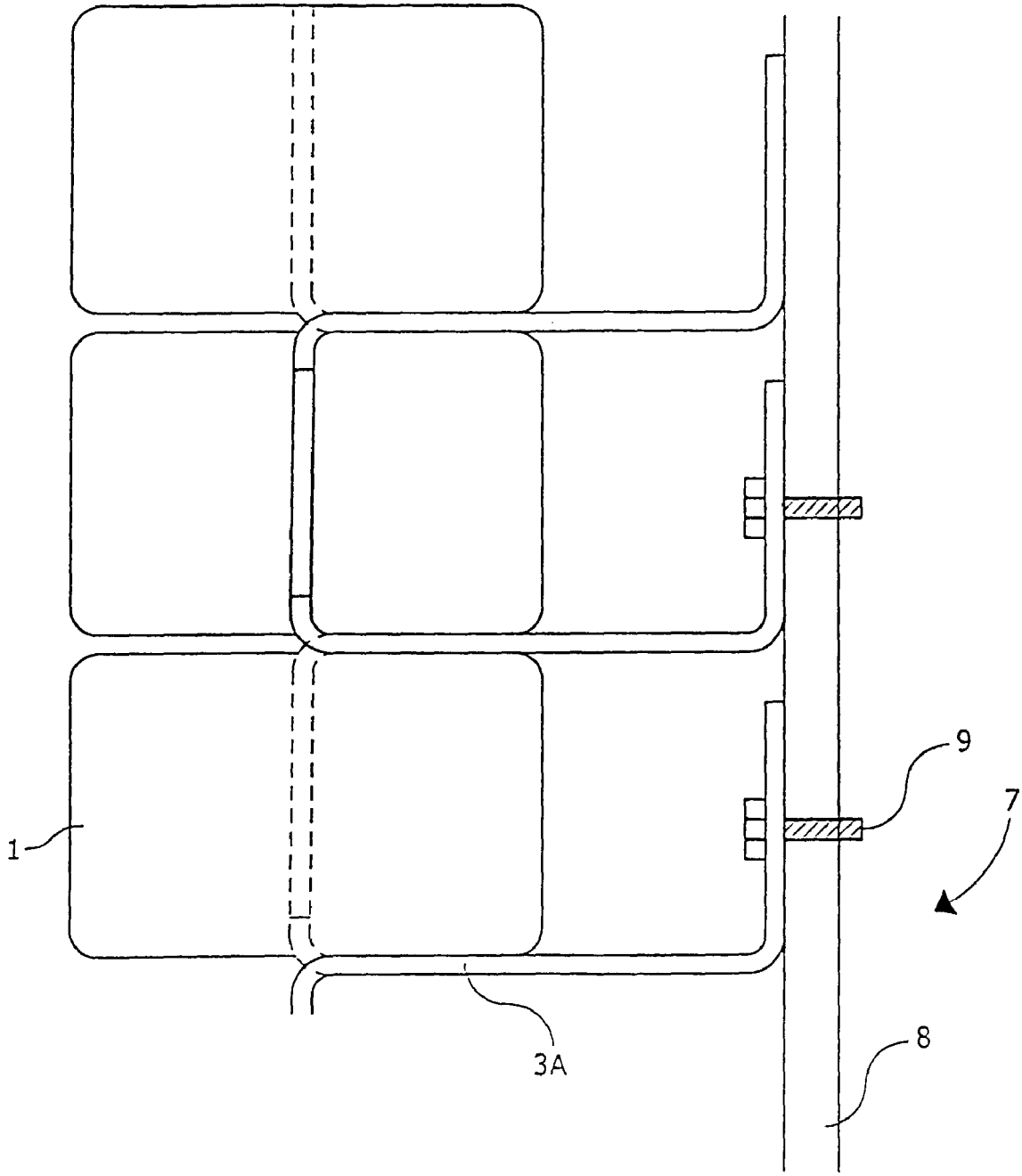
FIG. 9 shows a view corresponding with FIG. 7 of profiles according to the first embodiment.

FIG. 9 shows how the above mentioned elements 1 and profiles 2 are assembled to form a plane structure 7, a cross-section of which is shown in FIG. 3. The basis of the structure is formed by at least two columns 8 extending substantially vertically. These are preferably also made from aluminium, but can also be manufactured from steel, wood or plastic. They form a part of the bearing structure of the building of which the structure according to the invention forms part.

A lowermost profile 3A is fixed against these columns, for instance by screws 9. The profile thus forms a horizontally extending support for the elements 1 to be placed thereon. During placing of elements 1 they are placed such that the upward bent tongues 6A of the profile extend into the grooves 2 of elements 1. Tongues 6A herein lock the elements in horizontal direction, and both in lengthwise direction of the element and in transverse direction thereof.

The following profile 3B is then placed. The downward bent tongues 6B of the profile must herein extend into grooves 2 of elements 1. As in the engagement in the grooves by the upward bent tongues of the underlying profile, a tongue extends in two grooves of each different element. A single groove thus engages on two adjacent elements. Each element has two grooves, one on each side, which are each engaged by a different tongue. It is hereby possible to nevertheless obtain a good fixation with a minimal number of tongues.

When profile 3B has been placed, it is screwed to columns 8. The lowest layer of elements 1 in the figure is hereby locked. The subsequent layer of elements 1 is then placed, albeit offset over half the length of the elements so as to obtain a half-brick bond. These operations are repeated in order to obtain a complete wall structure.

In the above discussed construction the groove is not arranged in the centre of the width of the element, but slightly out of centre. This provides the option of arranging the elements in two different ways, i.e. far outward and less far outward. A relief can hereby be arranged in the wall.

In the construction shown above the profiles are straight, so that a straight wall is obtained. It is also possible however to apply curved profiles in order to obtain the curved walls very much in demand in modern architecture. For this purpose the elements will have to be made with slightly tapering end surfaces.

Although elements are applied above which have roughly the form of a brick, it is also possible to apply other forms, such as elements with a square surface or elongate elements.

It is also possible to have profiles 3 extend vertically, wherein during building the elements must of course be fixed temporarily before they are fixed by the following profile. The profiles can for that matter also be placed obliquely.

The invention is likewise applicable to horizontal and even sloping constructions, such as roofs. Temporary fixing of the elements must also be taken into account in horizontal constructions. Cassette-like elements are attractive here.

It is possible to connect the elements rigidly, without play, to the tongues of the profiles. This is particularly attractive in the case of floors. It is also possible to apply a small play, for instance to reduce the susceptibility to earthquake damage of buildings constructed with this structure.

An attractive advantage of the invention lies in the use as pallet from a limited number of elements with profiles.

The elements can be treated, for instance by applying a layer so as to obtain a desired appearance.

Successive structural elements in the lengthwise direction of the profiles can be placed directly in contact with each other with appropriate dimensioning of the profiles and the structural elements. It is however also possible to have the structural elements connect to each other with a certain joint. This joint can then be filled with joint mortar or with a mastic.

Figure 10:
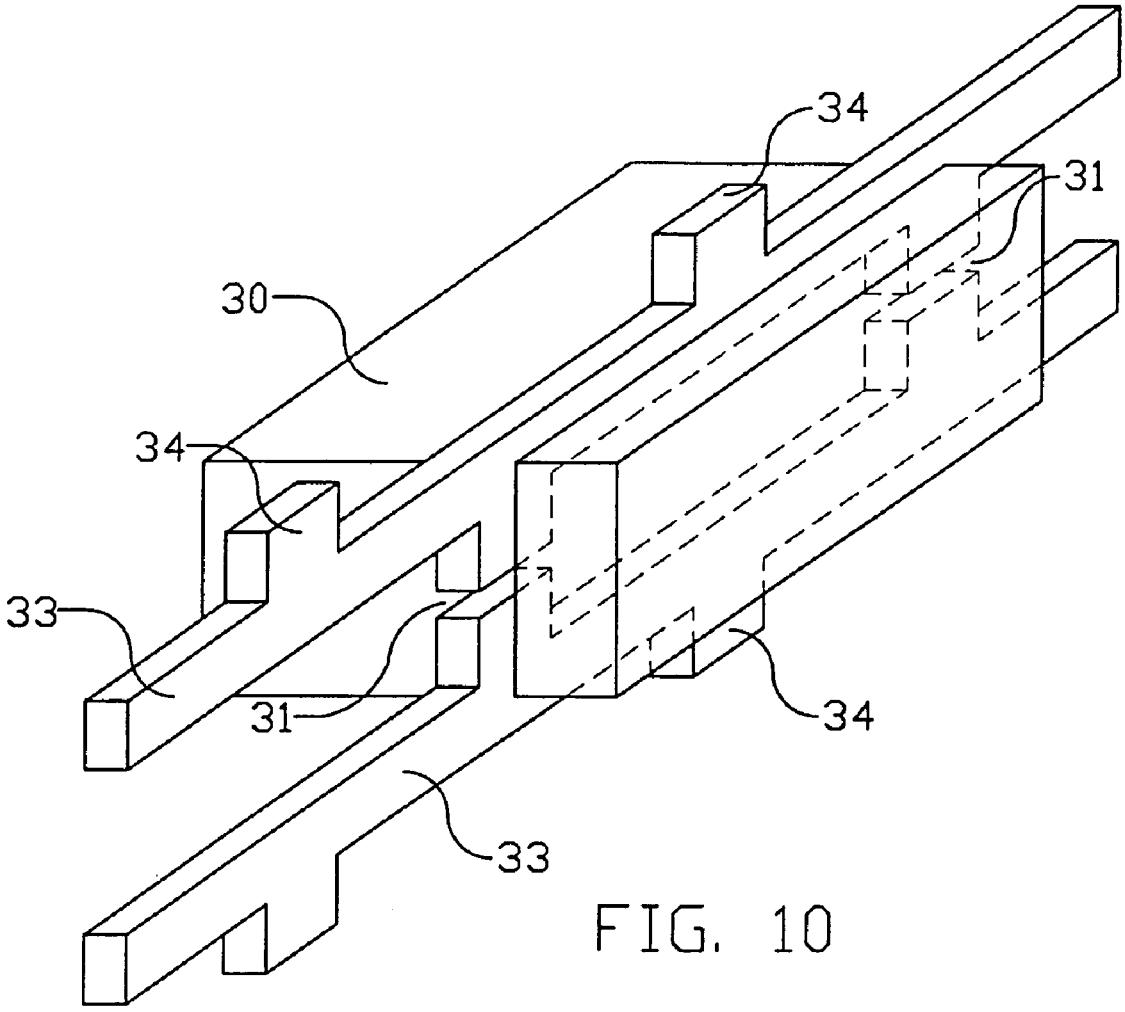
FIG. 10 is a schematic perspective view of a fourth embodiment.

FIG. 10 shows a fourth embodiment of the invention. Use is made here of flat profiles. No connection is made here between the flat profiles and a support structure extending parallel to the plane structure. In this situation the plane structure must itself be strong, or other measures must be taken. In the embodiment shown in FIG. 10 the element 30 is not only provided with transverse grooves 31 in the end surfaces but also with longitudinal grooves 32 in the longitudinal surfaces. The longitudinal grooves 32 are herein adapted to receive a part of profiles 33 extending in lengthwise direction. The element is fixed in transverse direction due to the presence of profile 33. As in the foregoing embodiments, use is made for fixation in lengthwise direction of protrusions 34 arranged on either side of profile 33. These protrusions 34 engage in transverse grooves 31, whereby a fixation in lengthwise direction is also obtained. To enable building in half-brick bond, the protrusions are displaced at half-pitch relative to each other. The advantage of this embodiment compared to the previous embodiments is the simplicity of profile 33, which can thus be produced considerably more cheaply. Furthermore, it is not necessary to make any attachment to a support structure. It is noted here that the profiles extend over more than one element, and preferably over a number of elements between two and ten.

FIG. 11 shows an embodiment which also has a cost-price which is low, but wherein an attachment to the support structure is however present. The structure shown in this embodiment substantially corresponds with that of the embodiment shown in FIG. 10, but in the embodiment shown in FIG. 11 anchors are applied to make an attachment to a structure extending substantially parallel. For this purpose recesses 35 are arranged in protrusions 34. When the structure according to the invention is stacked, protrusions 34 with recesses 35 come to lie opposite each other. It is then possible to arrange an anchor 36 in recesses 35. Anchors 36 are provided for this purpose with appropriate recesses 37 which engage on both profiles 33. A form-locking connection is hereby created. Anchor 36 can be connected to a support structure, such as an already existing wall against which the present structure is being built. This configuration is particularly attractive in renovation work. In the situation shown in FIG. 11 the anchor is otherwise arranged after the lower profile 33 has been placed and before the upper profile 33 is placed. The number of anchors 36 can be chosen subject to the applied configuration; it will generally not be necessary to place an anchor 36 between every pair of elements 30.

Figure 12:
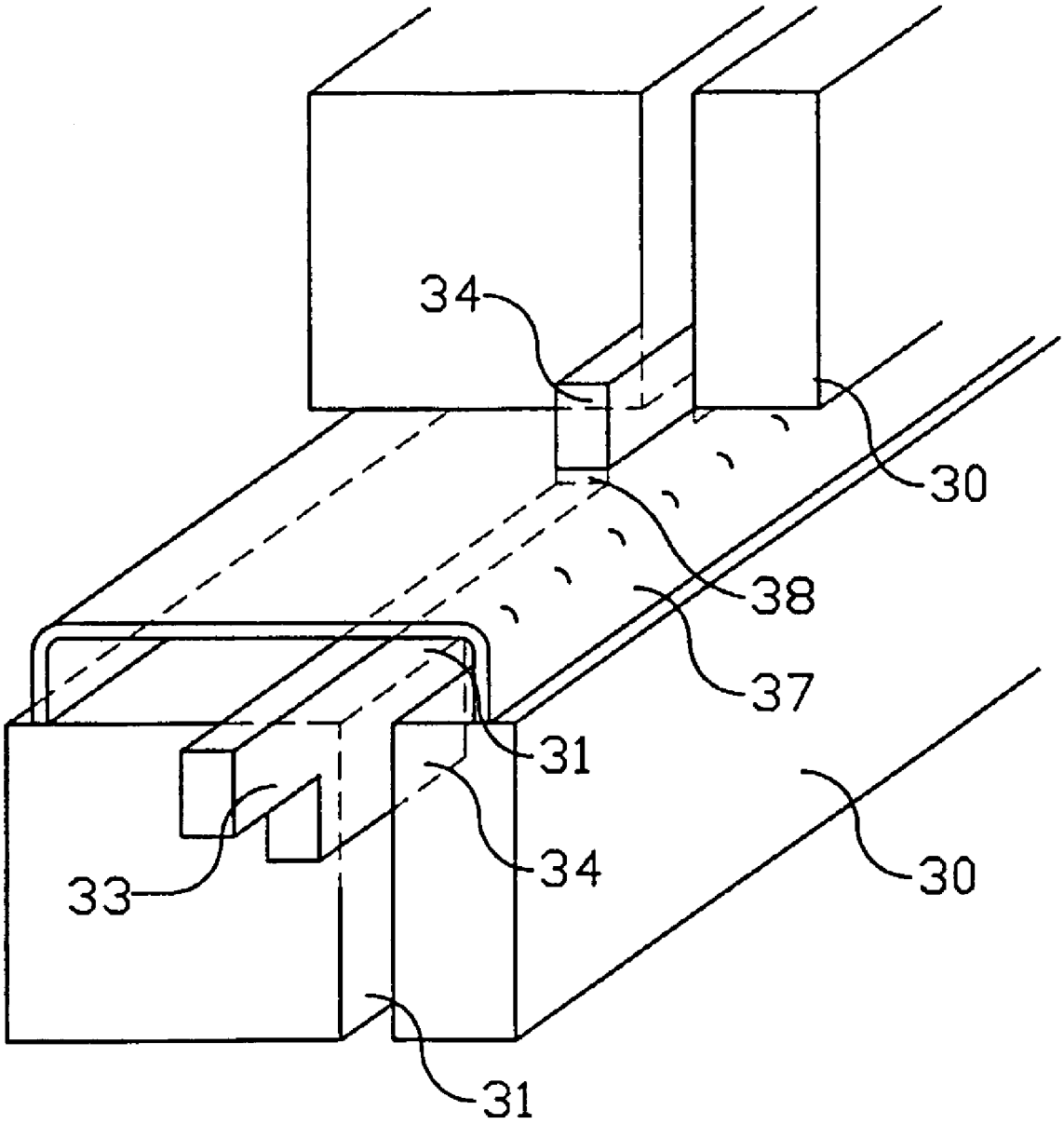
FIG. 12 shows a schematic perspective view of a fifth embodiment.

The above stated elements are all elements contacting each other in the transverse direction of the profiles. FIG. 12 shows an embodiment wherein elements connecting to each other in transverse direction of the profiles are separated by an auxiliary profile, thereby creating a joint. It is of course possible to provide this joint with pointing, but it is simpler to make the profile from a darker material, so that it appears on the face of it that pointing has taken place. The auxiliary profile is U-shaped in the embodiment shown here. This is related to the use of metal for the profile. It is possible to opt for other forms of profile, for instance a closed profile of rectangular cross-section, when for instance plastic is used. In the embodiment shown here the U-shaped auxiliary profile 37 is placed over profile 33. Openings 38 are therefore arranged in the auxiliary profile for the passage of protrusions 34, so that they can engage the elements 30 lying above. Although not shown in the drawing, it is possible to arrange the openings in the auxiliary profile to allow passage of a possible anchor.

Successive structural elements in the transverse direction of the profiles are generally separated from each other by a joint with the width of the profile width. It is not possible to reduce the joints altogether without additional measures. It is however possible to widen the joint. The profile can be provided with appropriate protrusions for the purpose of holding the structural element at a distance from the profile. These joints can also be filled with joint mortar or mastic.

In order to reduce the joints altogether, or, in other words, to have the structural elements connect to each other in transverse direction of the profiles, the profile must be inserted into the structural elements. Stated otherwise, the structural elements must be provided with widened portions at the position of the joint.

The invention claimed is:

1. A plane structure, comprising:

at least three longitudinal profiles extending equidistantly and mutually parallel in a longitudinal direction, the profiles having longitudinal axes in a plane of the plane structure;

a number of substantially parallelepiped shaped elements, each being arranged between an adjacent pair of the profiles;

wherein each of the substantially parallelepiped shaped elements is provided with at least one recess in both end walls of the element, the recesses being adapted for engagement by tongues arranged on the profiles;

wherein the tongues are arranged equidistantly on the profiles with a distance between pairs of adjacent tongues on one side of the profile being smaller than a length of the substantially parallelepiped shaped elements; and wherein the tongues extend from the profiles within the plane of the plane structure and perpendicular to the longitudinal direction of the profiles into the recesses arranged in the end walls of the substantially parallelepiped shaped elements.

2. The plane structure as claimed in claim 1, wherein both recesses in each of the end walls are united to form a single recess.

3. The plane structure as claimed in claim 1, wherein in both longitudinal faces of the substantially parallelepiped shaped elements adjacent to the profiles a groove has been provided which is engaged by the profile.

4. The plane structure as claimed in claim 3, wherein a sum of the depths of the grooves present on either side of an element is equal to or greater than the height of the profile and that mutually adjacent elements make mutual contact.

5. The plane structure as claimed in claim 1, wherein the tongues provided on either side of a profile are arranged staggered.

6. The plane structure as claimed in claim 1, wherein the profiles are coupled by means of an anchor to a parallel structure.

7. The plane structure as claimed in claim 1, wherein a joint extending in the longitudinal direction of the profiles is formed between successive substantially parallelepiped shaped elements in a transverse direction of the profiles.

8. The plane structure as claimed in claim 7, wherein an auxiliary profile is placed at the position of the joint.

* * * * *